United States Patent [19]

Cummins

[11] Patent Number: 4,825,777

[45] Date of Patent: May 2, 1989

[54] PEDESTAL LINER

[75] Inventor: Robert Cummins, Pittsburgh, Pa.

[73] Assignee: Mosebach Manufacturing Company, Pittsburgh, Pa.

[21] Appl. No.: 92,309

[22] Filed: Sep. 2, 1987

[51] Int. Cl.[4] ..... B61F 5/32

[52] U.S. Cl. ..... 105/225; 403/4; 403/408.1

[58] Field of Search ..... 105/225, 218.1, 222; 403/3, 4, 388, 408.1

[56] References Cited

U.S. PATENT DOCUMENTS

| | | | |
|---|---|---|---|
| 1,814,099 | 12/1929 | Todd . | |
| 1,903,859 | 4/1933 | Glascodine | 105/225 |
| 2,295,520 | 4/1940 | Parke . | |
| 3,554,618 | 1/1969 | Ditzler et al. . | |
| 4,094,253 | 6/1978 | Gage . | |
| 4,106,876 | 8/1978 | Tregoning | 403/4 |
| 4,168,666 | 9/1979 | Gage . | |
| 4,170,180 | 10/1979 | Houston . | |
| 4,313,384 | 2/1982 | Holden et al. . | |
| 4,316,417 | 2/1982 | Martin . | |
| 4,327,474 | 5/1982 | Holden et al. . | |
| 4,330,498 | 5/1982 | Kleykamp et al. . | |
| 4,333,404 | 6/1982 | Kleykamp . | |
| 4,380,199 | 4/1983 | Thomson et al. . | |
| 4,433,629 | 2/1984 | Roush, Jr. . | |
| 4,444,294 | 4/1984 | Yoshigai | 403/408.1 X |
| 4,469,466 | 9/1984 | Hotz | 403/388 |
| 4,657,296 | 4/1987 | Nishii et al. | 403/4 X |

OTHER PUBLICATIONS

The Polymer Corporation Bulletin, "Nylatron Nylon Wear Parts for Diesel-Electric Locomotive Trucks", 1984, pp. 1-8.

*Primary Examiner*—Stephen Hepperle
*Attorney, Agent, or Firm*—Buchanan Ingersoll

[57] ABSTRACT

A pedestal wear liner for trucks of diesel electric locomotives and other railway vehicles has a bight and a flange on each side. Each flange has openings in it corresponding to liner bolt holes in a pedestal leg but greater in area than those holes. Plugs which can be indexed in those openings are provided, one set of plugs having bolt holes aligned with pedestal bolt holes arranged in a first pattern; another set which has bolt holes aligned with pedestal bolt holes arranged in a second pattern and so on so that the same liner can be adapted for several vehicles.

9 Claims, 4 Drawing Sheets

PEDESTAL LINER

This invention relates to improvements in trucks for railroad diesel electric locomotives and other railroad vehicles. It is more particularly concerned with pedestal wear liners for the elements of the trucks which are slidably engaged to enable the truck wheels to move relative to each other and to the vehicle in a vertical direction.

BACKGROUND OF THE INVENTION

Trucks for locomotives and other railroad vehicles comprise a pair of side frames tied together by a bolster. In pedestal trucks, so called, the pedestals are integral with the side frames and are formed in inverted U-shape. Between the legs of the U is fitted a journal box so that it can move vertically with respect to the pedestal and the vehicle being supported on the truck. To minimize the wear of the pedestal in the journal box, antifriction materials are interposed between the sides of the journal box and the adjoining surfaces of the pedestal legs. A considerable number of materials has been proposed for pedestal liners, both metals and plastics, but all such liners must be removed and replaced from time to time. This invention is concerned with a form of pedestal liner which facilitates such replacement.

SUMMARY OF THE INVENTION

Pedestal wear liners are generally U-shaped in horizontal section with a central web portion or bight which fits between the wear face of a pedestal and a side of its journal box and a flange or leg on each side, one flange bearing against the inside and the other the outside face of the pedestal leg. Thus, each pedestal leg has its own liner. The liners are held in place by bolts which pass through holes in the liner flanges and into holes in the truck pedestals. However, each manufacturer of railroad vehicles locates the bolt holes in its own pattern which necessitates the manufacture of a variety of replacement pedestal liners, each significantly differing from the others only in the pattern of its bolt holes. The pedestal liners of my invention fit several pedestals with different bolt-hole patterns by being formed with openings or cutouts in the liner flanges of considerably greater area than the bolt holes in the pedestals and removeable plugs fitting into those openings and preferably being indexable therein. Each such plug has a bolt hole in it. I provide various sets of plugs with holes corresponding to various hole patterns in pedestal liner flanges and the user merely fits my pedestal liners with plugs which match his pedestal hole pattern. The openings in my liner legs are preferably in the form of regular polygons, such as squares, and the plugs are in the same form. I chamfer or bevel the edges of the liner leg openings or form shoulders thereon, and form the edges of the plugs in like manner so that when my liners and plugs are bolted into place the plugs hold the liners firmly against the pedestal legs.

A pedestal liner is normally formed to hold in its bight inserts or filler plugs which bear against the side of its journal box. As with the bolt hole pattern, the thickness of the filler plugs differs between various manufacturers of rail vehicles. I form my pedestal liner with an elongated recess at each side of its bight and removable elongated filler plugs which fit in those recesses. I make the filler plugs of various thicknesses so that by inserting filler plugs of the proper thickness, my pedestal liner may be adapted to the vehicles of various makers.

DESCRIPTION OF THE PREFERRED EMBODIMENT

Figure 1:
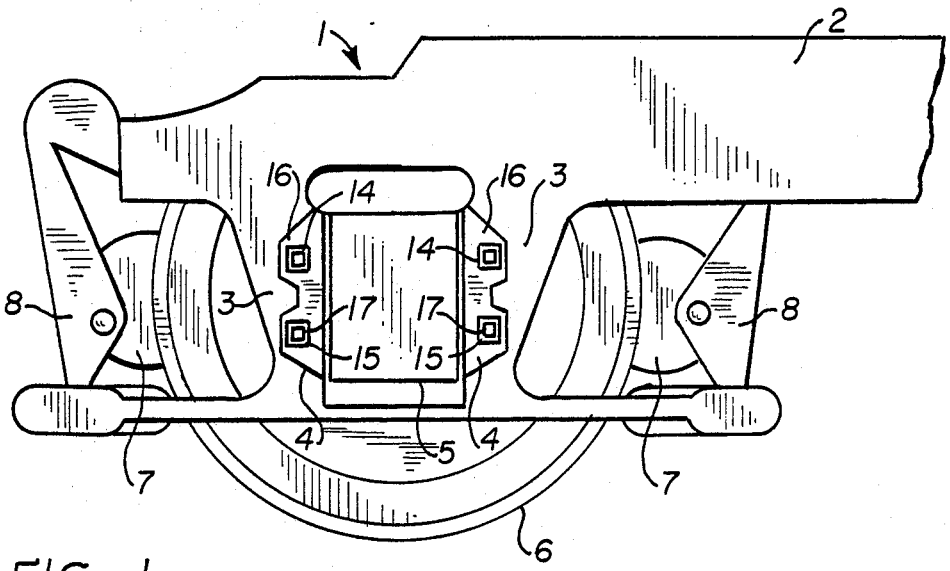
FIG. 1 is a side view, partially broken away, of the side frame of a pedestal truck illustrating the pedestal liners of my invention.

FIG. 1 illustrates a railroad truck of the pedestal type having a side frame 2 and pedestal legs 3—3. Attached to pedestal legs 3—3 are the assembled pedestal liners 4—4 of my invention. The pedestal liners 4 fit against the inside surfaces of the pedestal legs

3 of side frame 2, one on each side. A journal box 5 fits between opposite pedestal liners 4—4 so as to slide vertically with respect to pedestal legs 3—3. Wheel 6, brake shoe 7 and brake linkage 8 are not part of my invention. Pedestal liners 4—4 are attached to the pedestal legs 3—3 by first bolts 16 passing through plugs 14 and second bolts 17 passing through plugs 15 in a manner to be described hereinafter.

Figure 3:
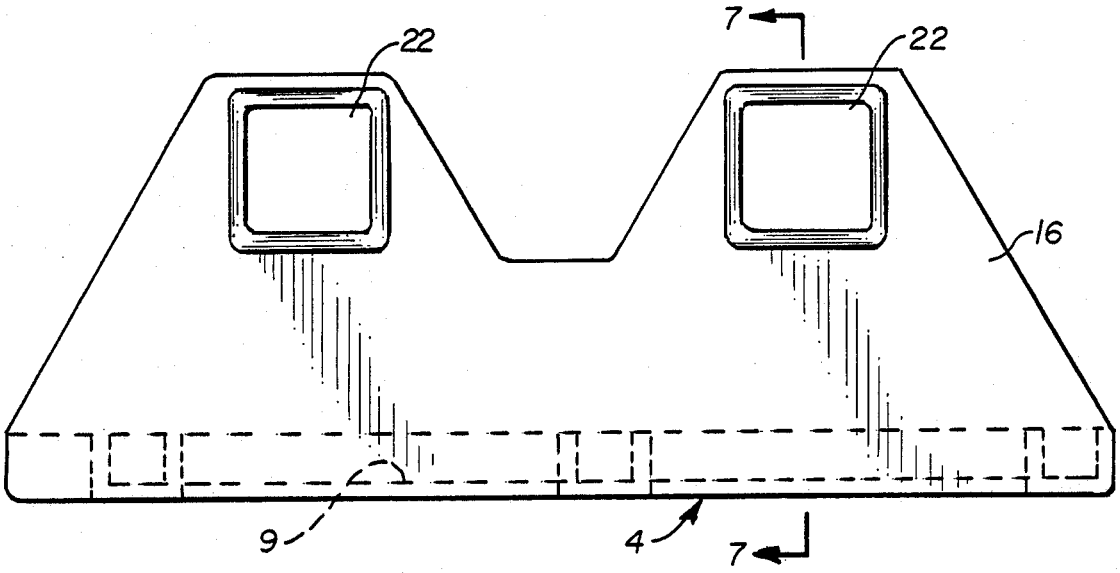
FIG. 3 is a side elevation of my pedestal liner.
Figure 2:
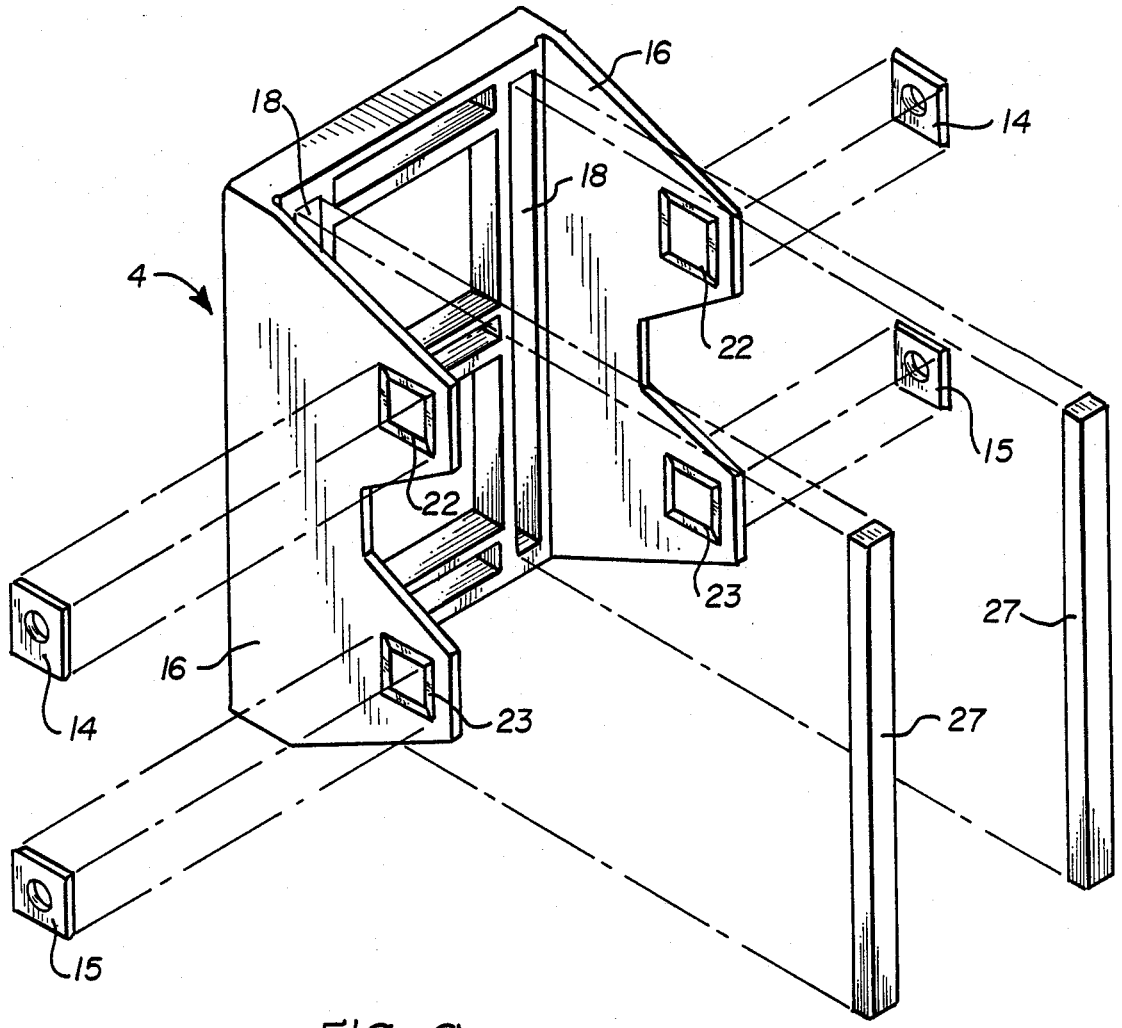
FIG. 2 is an exploded view of my pedestal liner and pedestal liner inserts illustrating the pedestal liner openings.

FIG. 2 illustrates a pedestal liner 4, a pedestal liner filler plug 27, a pair of square plugs 14—14, a second pair of square plugs 15—15, a first pair of cutouts or openings 22—22, and second pair 23—23 in the side walls or flanges 16 of my liner. As is best seen in FIG. 3, the openings 22—22 and 23—23 are square in shape. The edges of those openings are preferably chamfered or bevelled, preferably at 45°, as is shown at 13 in FIG. 7 so that the dimensions of openings 22 and 23 in the outside face 16 of liner 4 are greater than the dimensions of those openings in the inside face of that liner.

Figure 4:
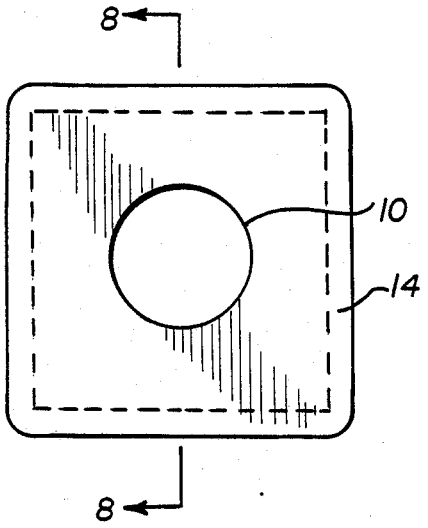
FIG. 4 is a plan of a square plug of my invention for a pedestal liner in which the liner bolt hole is centrally located with respect to the liner opening.
Figure 8:
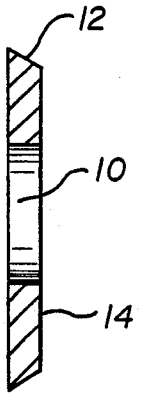
FIG. 8 is a cross section of the plug of FIG. 4 taken on the plane 8—8 of that figure.
Figure 9:
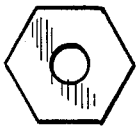
FIG. 9 is a plan of a hexagonal plug with centrally located bolt hole.
Figure 10:
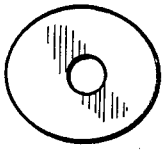
FIG. 10 is a plan of an oval plug with centrally located bolt hole.
Figure 11:
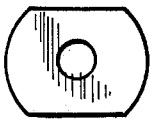
FIG. 11 is a plan of a plug with two parallel sides and arcuate ends, also with central bolt hole.
Figure 12:
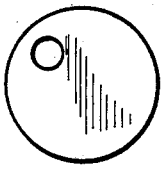
FIG. 12 is a plan of a circular plug with off-center bolt hole.

Plugs 14 shown in FIG. 4 are dimensioned to fit in the openings or cutouts 22 and 23, above described, and are bevelled or chamfered on their edges 12, FIG. 8, to match the chamfers of openings 22 and 23. Plug 14 has a bolt hole 10 centrally located therein of a size to accept a pedestal liner fastening bolt. As is shown in FIG. 2, my pedestal liners 4 have corresponding openings 22 and 23 in both outside and inside flanges and, as has been mentioned, those openings are positioned so as to surround the bolt holes in the patterns of location of such holes selected by various locomotive and railway vehicle manufacters. The plug of FIG. 4 is designed to fit the hole pattern which locates the bolt holes centrally in the openings. Four identical plugs of the type shown in FIG. 4 are placed in the the four openings of a pedestal liner and the mounting bolts are passed therethrough.

Figure 5:
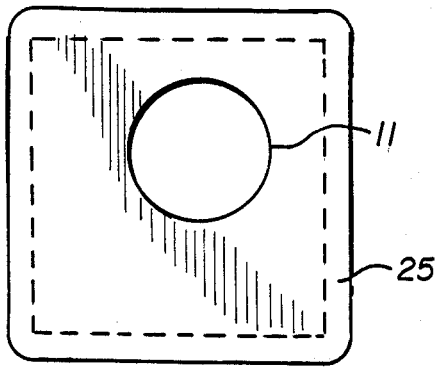
FIGS. 5 and 6 are plan views of a pair of square plugs of my invention for a pedestal liner in which each liner bolt hole is not centrally located with respect to the liner opening.
Figure 6:
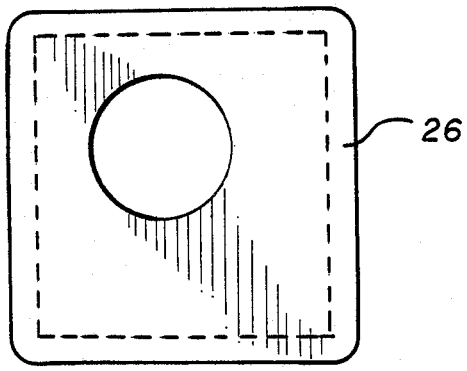

As my pedestal liner is desiged for use with vehicles having different patterns of pedestal bolt holes, plugs different from those of FIG. 4 are required for each different pattern. FIG. 5 illustrates such a plug 25, otherwise identical with that of FIG. 4, but having a bolt hole 11 not centrally located in the plug. FIG. 6 illustrates a plug 26 which is a mirror image of the plug of FIG. 5 as far as bolt-hole location is concerned. Two plugs of the type shown in FIG. 5 and two of the type shown in FIG. 6 are required for that pattern of pedestal mounting holes.

Figure 7:
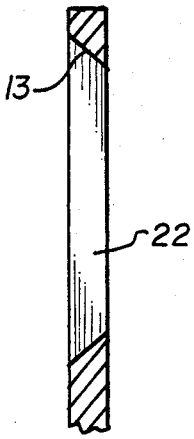
FIG. 7 is a vertical section through a portion of the liner of FIG. 3 on the plane 7—7 of FIG. 3.
Figure 13:
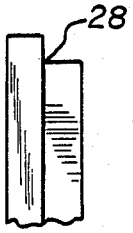
FIG. 13 is a partial side elevation of another embodiment of any of the plugs of the foregoing figures.
Figure 14:
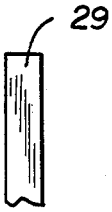
FIG. 14 is a partial side elevation of still another embodiment of any of the plugs of the foregoing figures.

My plugs and openings may take any suitable shape. FIGS. 9, 10, 11 and 12 illustrate plugs hexagonal, oval, composite and circular respectively, in plan, the first three with centrally located bolt holes. The plugs may, of course, have bolt holes unsymmetrically located with respect to the face of the plug, like the holes in the plugs of FIGS. 5 and 12. The edges of the openings and of the plugs may be bevelled at 13 and 12, respectively, as illustrated in FIGS. 7 and 8, or may be formed with a shoulder 28 as shown in FIG. 13, or square edge as shown at 29 in FIG. 14.

Figure 15:
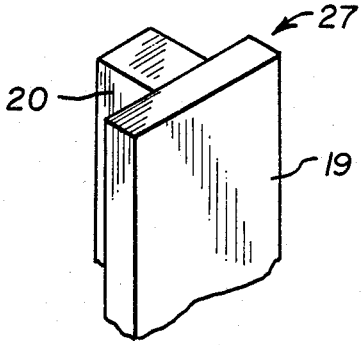
FIG. 15 is a partial isometric view of a second form of pedestal liner filler plug.

The web or bight 9 of my pedestal liner is formed with elongated channel recesses 18 adjoining each flange 16 of liner 4. Those recesses accommodate filler plugs 27, the thickness of which normal to web 9 is made to correspond to the gap between the side of the journal box 5 and the face of the pedestal liner web 9. As the vehicles of various manufacturers have gaps of different depths, I provide filler plugs 27 of different thicknesses. The thicker fillers may take the form of the filler plug of FIG. 15, that is to say, with an exterior portion 19 wider than the portion 20 which fits in recess 18. Filler plugs with exterior portions 19 of different thicknesses allow my article to be fitted to a number of rail vehicles of different suppliers.

Various synthetic compounds, specifically nylon, have proved satisfactory for pedestal liners. My invention is not limited to liners of any specific composition.

I claim:

1. In a pedestal liner for railway trucks having pairs of pedestal legs between each pair of which a journal box is disposed, said liner comprising a bight and a pair of flanges and being adapted to be disposed between an associated leg and journal box, said railway trucks of different manufacturers each having liner fastener mounting holes in its pedestal legs in a pattern distinctive of its manufacturer, the improvement comprising:

openings in said flanges for liner mounting holes, each opening being of an area sufficient to encompass the correspondingly positioned liner mounting holes of said distinctive patterns, and removable plugs fitting in to said openings, each plug having a liner fastening hole therethrough and being positionable in its opening so that its liner fastener hole corresponds with a liner fastener mounting hole of one of said distinctive patterns and a fastener therethrough holds said liner firmly against said pedestal.

2. The pedestal of claim 1 in which the plugs are indexable in the flange openings.

3. The pedestal liner of claim 1 in which the openings and the plugs are in the form of regular polygons.

4. The pedestal liner of claim 1 in which the openings and the plugs are squares.

5. The pedestal liner of claim 1 in which the openings and plugs have perimeters curved at least in part.

6. The pedestal liner of claim 1 in which the edges of the openings and the outer edges of the plugs are bevelled to fit each other.

7. The pedestal liner of claim 1 in which the edges of the openings and the outer edges of the plugs are formed with cooperating shoulders.

8. The pedestal liner of claim 1 in which the bight has separate elongated recesses adjoining its flanges to receive filler plugs and including filler plugs fitting said recesses.

9. The pedestal liner of claim 7 in which the filler plugs comprise an underlying portion fitting into said bight recess and an overlying portion which rests against the face of said bight.

* * * * *